US007992860B2

(12) United States Patent
Kimura et al.

(10) Patent No.: US 7,992,860 B2
(45) Date of Patent: Aug. 9, 2011

(54) SHEET FEEDING DEVICE, IMAGE FORMING APPARATUS, AND SHEET FEEDING METHOD

(75) Inventors: Ippei Kimura, Osaka (JP); Yasuo Matsuyama, Hyogo (JP); Hiroshi Fujiwara, Osaka (JP); Yasuhide Ohkubo, Osaka (JP); Toshikane Nishii, Osaka (JP); Mizuna Tanaka, Osaka (JP); Tomoyoshi Yamazaki, Osaka (JP); Haruyuki Honda, Osaka (JP); Masafumi Takahira, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 153 days.

(21) Appl. No.: 12/453,531

(22) Filed: May 14, 2009

(65) Prior Publication Data

US 2009/0315250 A1 Dec. 24, 2009

(30) Foreign Application Priority Data

Jun. 19, 2008 (JP) ..... 2008-160894

(51) Int. Cl.
*B65H 3/52* (2006.01)

(52) U.S. Cl. ..... 271/121

(58) Field of Classification Search ..... 271/121
See application file for complete search history.

(56) References Cited

U.S. PATENT DOCUMENTS

| | | | | |
|---|---|---|---|---|
| 3,804,400 | A * | 4/1974 | Hunt et al. | 271/10.11 |
| 4,925,062 | A * | 5/1990 | Tsukamoto et al. | 271/115 |
| 5,219,154 | A | 6/1993 | Fukube et al. | |
| 5,316,282 | A | 5/1994 | Fukube et al. | |
| 5,322,269 | A | 6/1994 | Fukube et al. | |
| 5,405,128 | A | 4/1995 | Fujiwara et al. | |
| 5,707,057 | A * | 1/1998 | Oyama | 271/121 |
| 7,484,723 | B2 * | 2/2009 | Kuo et al. | 271/10.09 |
| 7,510,179 | B2 * | 3/2009 | Kim | 271/121 |
| 2006/0290049 | A1 | 12/2006 | Fujiwara et al. | |
| 2007/0065201 | A1 | 3/2007 | Fujiwara et al. | |
| 2007/0172255 | A1 | 7/2007 | Nanno et al. | |
| 2007/0273085 | A1 | 11/2007 | Nanno et al. | |
| 2007/0285701 | A1 | 12/2007 | Ohta et al. | |
| 2008/0006166 | A1 | 1/2008 | Ohkubo et al. | |

(Continued)

FOREIGN PATENT DOCUMENTS

JP 9-202475 8/1997

(Continued)

OTHER PUBLICATIONS

An English language abstract of Japanese Publication No. JP 4-354740, dated Dec. 9, 1992.

(Continued)

*Primary Examiner* — David H Bollinger
(74) *Attorney, Agent, or Firm* — Harness, Dickey & Pierce, P.L.C.

(57) ABSTRACT

A sheet feeding device includes a first roller that draws a recording medium at a first position and feeds the recording medium; a friction pad that comes into contact with the first roller with a predetermined contact pressure at a second position that is close to and downstream of the first position in a conveying direction of the recording medium and nips the recording medium with the first roller to convey the recording medium in the conveying direction; and a second roller that comes into contact with the first roller at a third position that is close to and downstream of the second position in the conveying direction and nips the recording medium with the first roller.

15 Claims, 9 Drawing Sheets

U.S. PATENT DOCUMENTS

| | | | |
|---|---|---|---|
| 2008/0054554 | A1 | 3/2008 | Nishii et al. |
| 2008/0138100 | A1 | 6/2008 | Matsuyama |
| 2008/0143046 | A1 | 6/2008 | Nishii et al. |
| 2008/0224385 | A1 | 9/2008 | Takahira et al. |
| 2008/0226358 | A1 | 9/2008 | Hanashima et al. |
| 2008/0237970 | A1 | 10/2008 | Tanaka et al. |
| 2008/0273908 | A1 | 11/2008 | Ohkubo et al. |
| 2008/0284090 | A1 | 11/2008 | Honda et al. |
| 2009/0022514 | A1 | 1/2009 | Fujiwara et al. |
| 2009/0056484 | A1 | 3/2009 | Hanashima et al. |

FOREIGN PATENT DOCUMENTS

| | | |
|---|---|---|
| JP | 2991816 | 10/1999 |
| JP | 2000-185837 | 7/2000 |
| JP | 3911113 | 10/2001 |
| JP | 2002-154694 | 5/2002 |
| JP | 2006-306597 | 11/2006 |

OTHER PUBLICATIONS

An English language abstract of Japanese Publication No. JP 2001-302004, dated Oct. 31, 2001.

* cited by examiner

SHEET FEEDING DEVICE, IMAGE FORMING APPARATUS, AND SHEET FEEDING METHOD

CROSS-REFERENCE TO RELATED APPLICATIONS

The present application claims priority to and incorporates by reference the entire contents of Japanese priority document 2008-160894 filed in Japan on Jun. 19, 2008.

BACKGROUND OF THE INVENTION

1. Field of the Invention

The present invention relates to a technology for feeding a recording medium in an image forming apparatus.

2. Description of the Related Art

When a recording sheet is picked up from a sheet tray and conveyed, multi feed may occur, necessitating the sheets to be separated one by one after being picked up. FIG. 8 is a schematic diagram of a feed roller arranging portion of a conventional sheet feeding device showing a relation between a feed roller 48 and a friction pad 49. The feed roller 48 is provided at the most downstream end of the sheet tray in a sheet feeding direction, and the friction pad 49 for separating recording sheets is provided on the downstream side in a sheet drawing direction. The friction pad 49 is made of a material that produces a kinetic frictional resistance that is at least greater than the kinetic frictional resistance between recording sheets. The friction pad 49 includes a spring 49*a* and a pad support 49*d*, and produces a designated kinetic frictional resistance by launching the pad support 49*d*, with the spring 49*a* imparting a predetermined contact pressure. Thus, when two recording sheets are conveyed at a time, a first recording sheet in contact with the feed roller 48 is separated from a second recording sheet in contact with the friction pad 49 because the kinetic frictional resistance between the recording sheets is smaller than that between the second recording sheet and the friction pad 49, and is conveyed towards a pair of registration rollers 46*a* and 46*b* along a sheet conveying path 42.

In the sheet feeding device having the structure described above, the recording sheet is only nipped at the point where the feed roller 48 and the friction pad 49 are in contact. In such a structure, stick-slip vibrations generated by the friction between the friction pad 49 and the recording sheet cannot be suppressed, so that conveying behavior and conveying accuracy do not become stable and abnormal sound is generated.

Various technologies have been known to prevent or suppress abnormal sound at the time of separating recording sheets, such as those disclosed in Japanese Patent No. 3911113, Japanese Patent Application Laid-open No. 2006-306597, and Japanese Patent Application Laid-open No. 2002-154694.

Japanese Patent No. 3911113 discloses a sheet separating/feeding device, that separates the leading edges of a plurality of sheets that are conveyed from upstream of a friction pad in a sheet conveying direction in an overlapping manner, separates the sheets one by one at a nip between a rotating feed roller and the friction pad downstream of the friction pad in the sheet conveying direction, and feeds the separated sheets. The friction pad is mounted on a pad holder in such a way that the surface area of the friction pad is less on the downstream side than on the upstream side in the sheet feeding direction. Furthermore, concaves and convexes are formed on the surface of the pad holder on the downstream side of the sheet feeding direction to set a coefficient of friction to the pad holder on the downstream side.

Japanese Patent Application Laid-open No. 2006-306597 discloses a sheet separating device that separates sheets fed from a sheet stack contained in a sheet cassette one by one. The sheet separating device includes a separation roller that picks up the topmost sheet by coming into pressure-contact with the sheet and a slanting member that includes a slant portion that is in pressure-contact with the separation roller and applies resistance to the leading edge of the sheet with respect to a direction of a sheet entry route.

Japanese Patent Application Laid-open No. 2002-154694 discloses a sheet feeding device that includes a pickup roller that is arranged in contact with the lower side of a sheet, and a swingable pressure plate that comes into contact with the upper side of the sheet via a sheet member and presses the sheet against the pickup roller. The sheet is fed in a predetermined direction while being nipped by a nip formed by the pickup roller and the pressure plate via the sheet member. An intermediate sheet member is provided between the pressure plate and the sheet member.

Although the technologies described above intend to prevent multi feed and abnormal sound, it is hard to sufficiently suppress or prevent abnormal sound due to the stick-slip vibrations.

SUMMARY OF THE INVENTION

It is an object of the present invention to at least partially solve the problems in the conventional technology.

According to an aspect of the present invention, there is provided a sheet feeding device includes a first roller that draws a recording medium at a first position and feeds the recording medium; a friction pad that comes into contact with the first roller with a predetermined contact pressure at a second position that is close to and downstream of the first position in a conveying direction of the recording medium and nips the recording medium with the first roller to convey the recording medium in the conveying direction; and a second roller that comes into contact with the first roller at a third position that is close to and downstream of the second position in the conveying direction and nips the recording medium with the first roller.

According to another aspect of the present invention, there is provided an image forming apparatus including the above sheet feeding device.

According to still another aspect of the present invention, there is provided a sheet feeding method that is implemented on a sheet feeding device that includes a first roller that draws a recording medium at a first position and feeds the recording medium, and a friction pad that comes into contact with the first roller with a predetermined contact pressure at a second position that is close to and downstream of the first position in a conveying direction of the recording medium and nips the recording medium with the first roller to convey the recording medium in the conveying direction. The sheet feeding method includes nipping the recording medium at a third position that is close to and downstream of the second position in the conveying direction and nips the recording medium in a state in which a predetermined pressure is applied to the first roller; and conveying the recording medium in a state of being nipped at the nipping.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Figure 1:
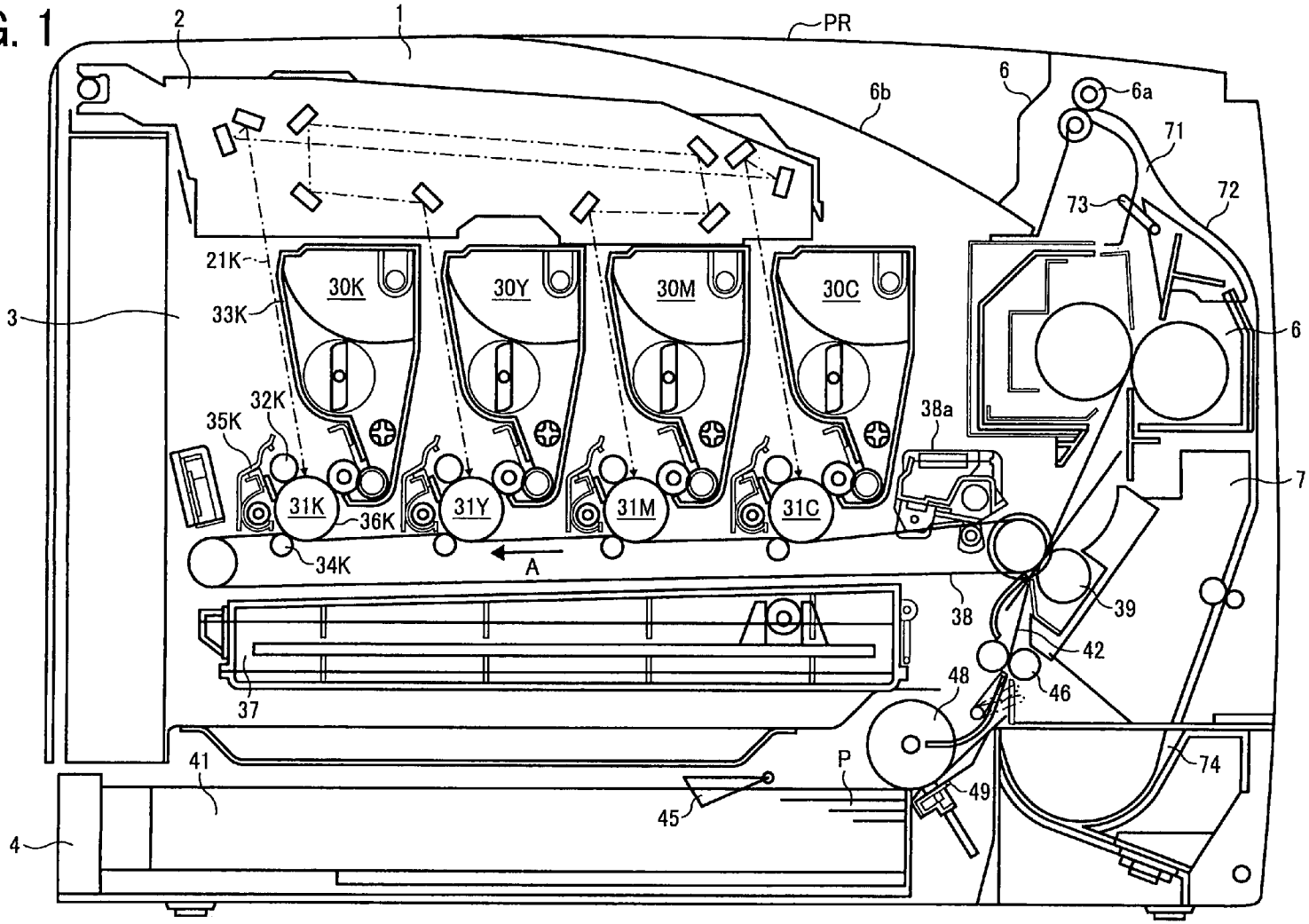
FIG. 1 is a schematic diagram of an image forming apparatus according to a first embodiment of the present invention.

FIG. 1 is a schematic diagram of an image forming apparatus 1 according to a first embodiment of the present invention. The image forming apparatus 1 is a tandem type color image forming apparatus as a printer that employs an indirect transfer method and in which four image forming units are arranged in a row, each image forming unit including an image carrier and a developing device in the periphery of the image carrier. In FIG. 1, the developing devices and the image carriers are fitted into an apparatus body of the image forming apparatus 1.

The image forming apparatus 1 includes an optical writing device 2, an image forming device 3, a sheet feeding device 4, a fixing device 5, a discharging device 6, and a conveying device 7 for-both side image formation.

Although not shown in detail in FIG. 1, the optical writing device 2 includes a laser diode (LD) unit that serves as a light source, a polygon mirror, and a plurality of reflecting mirrors. For performing laser writing, the LD unit emits laser beams for different colors, which are irradiated on photosensitive elements 31C, 31M, 31Y, and 31K of image forming units 30C, 30M, 30Y, and 30K, respectively, of the image forming device 3 via the polygon mirror and the reflecting mirrors. The optical writing device 2 performs the laser writing by irradiating the photosensitive elements 31C, 31M, 31Y, and 31K with laser beams that are modulated by modulation signals created based on write data, thereby forming latent images on the surfaces of the photosensitive elements 31C, 31M, 31Y, and 31K.

The image forming device 3 is arranged in substantially a center area of the image forming apparatus 1, and includes the image forming units 30C, 30M, 30Y, and 30K for cyan, magenta, yellow, and black, respectively, an intermediate transfer belt 38 as an image carrier, and a secondary transfer roller 39. Each of the image forming units 30C, 30M, 30Y, and 30K includes electrophotographic image-forming components that are arranged along the outer periphery of the corresponding photosensitive elements 31C, 31M, 31Y, and 31K. Because the structure is the same for all the colors, only components that are concerned with black (K) have been assigned the reference symbol K; however, the image forming units 30C, 30M, 30Y, and 30K are arranged in a row along a moving direction of the intermediate transfer belt 38. In the case of collectively explaining each component, the reference symbols C, M, Y, and K will be omitted.

Along the outer periphery of the photosensitive element 31K in a clockwise direction in FIG. 1 are arranged image-forming components that are a charging roller 32K that charges the surface of the photosensitive element 31K, a developing device 33K that contains developer containing toner and develops a latent image on the photosensitive element 31K into a toner image, a primary transfer roller 34K that primary-transfers the toner image on the photosensitive element 31K onto the intermediate transfer belt 38, a cleaning unit 35K that includes a cleaning blade for scraping residual toner on the photosensitive element 31K after the primary transfer, and a neutralizing unit (not shown) that neutralizes the surface of the photosensitive element 31K after the primary transfer. A laser beam 21K is irradiated on the photosensitive element 31K from an exposure portion 36K arranged between the charging roller 32K and the developing device 33K, thereby performing the optical writing on the photosensitive element 31K. The image forming units 30C, 30M, 30Y, and 30K are arranged in this order along the moving direction (in the direction indicated by an arrow A in FIG. 1) of the intermediate transfer belt 38. The primary transfer roller 34K and the photosensitive element 31 are arranged facing each other with the intermediate transfer belt 38 sandwiched therebetween. As shown in FIG. 1, a waste-toner collecting unit 37 is arranged below the image forming device 3.

The secondary transfer roller 39 is arranged upstream of the image forming unit 30C in a conveying direction of the intermediate transfer belt 38 to sandwich the sheet conveying path 42 extending from the sheet feeding device 4 with the intermediate transfer belt 38. The secondary transfer roller 39 transfers the toner image on the intermediate transfer belt 38 onto a sheet-like recording medium such as a sheet of paper. An intermediate-transfer-belt cleaning unit 38*a*, arranged downstream of the secondary transfer roller 39 and upstream of the image forming unit 30C in the conveying direction of the intermediate transfer belt 38, removes the residual toner on the intermediate transfer belt 38 after the toner image is secondary-transferred by the secondary transfer roller 39, and is conveyed to a downstream image-forming unit.

A bias power source (not shown) applies a negative bias voltage in which an alternating-current voltage and a direct-current voltage are superimposed to a core of a developing roller 33*a* of the developing device 33. Furthermore, another bias power source applies a direct current negative bias voltage to the charging roller 32.

The cleaning blade of the cleaning unit 35 removes the residual toner on the surface of the photosensitive element 31 to clean the surface. The charging roller 32 initializes the cleaned surface of the photosensitive element 31 by uniformly charging it to a high voltage. The laser beam 21 is irradiated on the charged surface of the photosensitive element 31. Specifically, the laser beam 21, modulated based on the image data, selectively exposes the surface of the photosensitive element 31, forming an electrostatic latent image having a low potential portion where the potential is reduced by exposure and a high potential portion that is charged by the charging roller 32. The developing device 33 transfers the toner onto the low potential portion (or the high potential portion) of the latent image to form a toner image (that is, the developing device 33 develops the latent image into a toner image). The toner image is conveyed along with the rotation of the photosensitive element 31 and is transferred onto the intermediate transfer belt 38.

The image forming unit 30 corresponding to each color is actuated in synchronization with the arrival of the toner image on the intermediate transfer belt 38 to the contact point with the photosensitive element 31, and the developing device 33 develops the latent image and a primary transfer roller 34 performs the primary transfer. Thus, a full color image is formed on the intermediate transfer belt 38 by the superimposition of cyan, magenta, yellow, and black toner images.

The secondary transfer roller 39 transfers the full color image on the intermediate transfer belt 38 onto the recording sheet conveyed from the sheet feeding device 4 along the sheet conveying path 42, and the fixing device 5 fixes the full color image on the recording sheet by heat and pressure. The recording sheet bearing the color image thereon is discharged to a discharge tray 6*b* by a discharge roller 6*a* of the discharging device 6. Recording sheets P stacked in a stacking tray 41 of the sheet feeding device 4 are separated by the feed roller 48 and a friction pad 49 one by one, and conveyed to the registration rollers 46*a* and 46*b*. Edge alignment of the recording sheet P takes place when the leading edge of the recording sheet P comes into contact with a nip portion of the registration rollers 46*a* and 46*b*. The registration rollers 46*a* and 46*b* temporarily stops conveying the recording sheet P, and starts to rotate at a timing in which the toner image on the intermediate transfer belt 38 has a predetermined positional relationship with the leading edge of the recording sheet P.

For forming an image on both the sides of the recording sheet P are used for image formation, the discharge roller 6*a* starts rotating in a reverse direction immediately after the trailing edge of the recording sheet P with an image fixed on one side passes a branching point 71. By this action, the leading edge and the trailing edge of the recording sheet are switched, and the recording sheet P is conveyed to a conveying path 72 for both-side image formation. The recoding sheet P then passes through a sheet re-feeding path 74 and is conveyed to the registration rollers 46*a* and 46*b* again. The registration rollers 46*a* and 46*b* convey the recording sheet P to the secondary transfer roller 39 in synchronization with the arrival of the toner image formed on the intermediate transfer belt 38 thereby transferring the toner image onto the back side of the recording sheet P. The fixing device 5 fixes the toner image on the back side of the recording sheet P. Thereafter, the discharge roller 6*a* discharges the recording sheet P to the discharge tray 6*b*. A feeler 73 that detects the recording sheet P is arranged near the switching point 71 on the upstream side in the sheet conveying direction.

The sheet feeding device 4 includes the stacking tray 41 containing unused recording sheets P. The stacking tray 41 (excluding the feed roller 48, a sheet detection sensor 45, and the like) can be drawn out as a single unit from the apparatus body towards the right in FIG. 1 together with a paper re-feeding path arranging unit and the friction pad 49.

Figure 2:
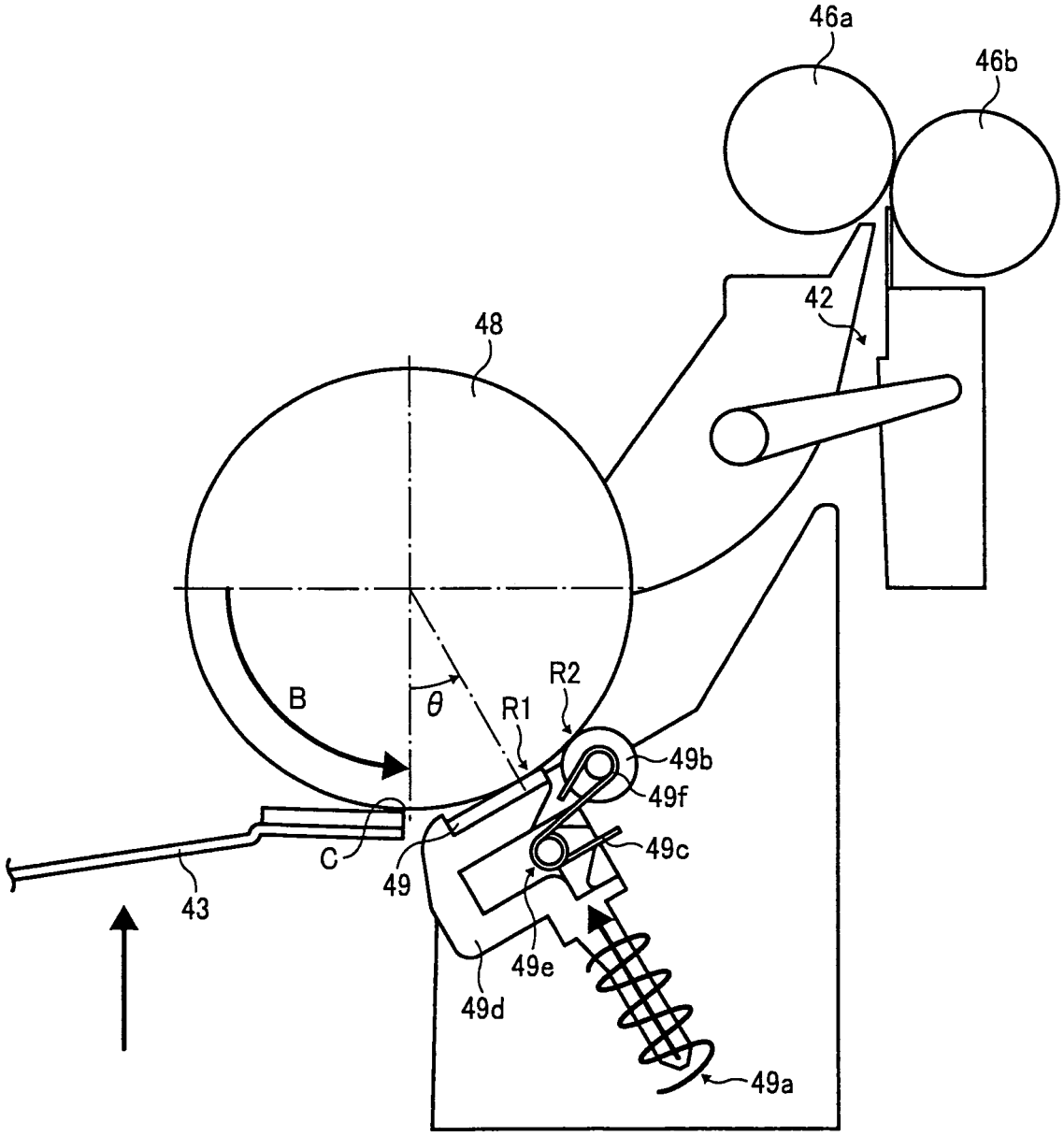
FIG. 2 is a schematic diagram of a feeding roller arranging portion of a sheet feeding device according to the first embodiment.
Figure 3:
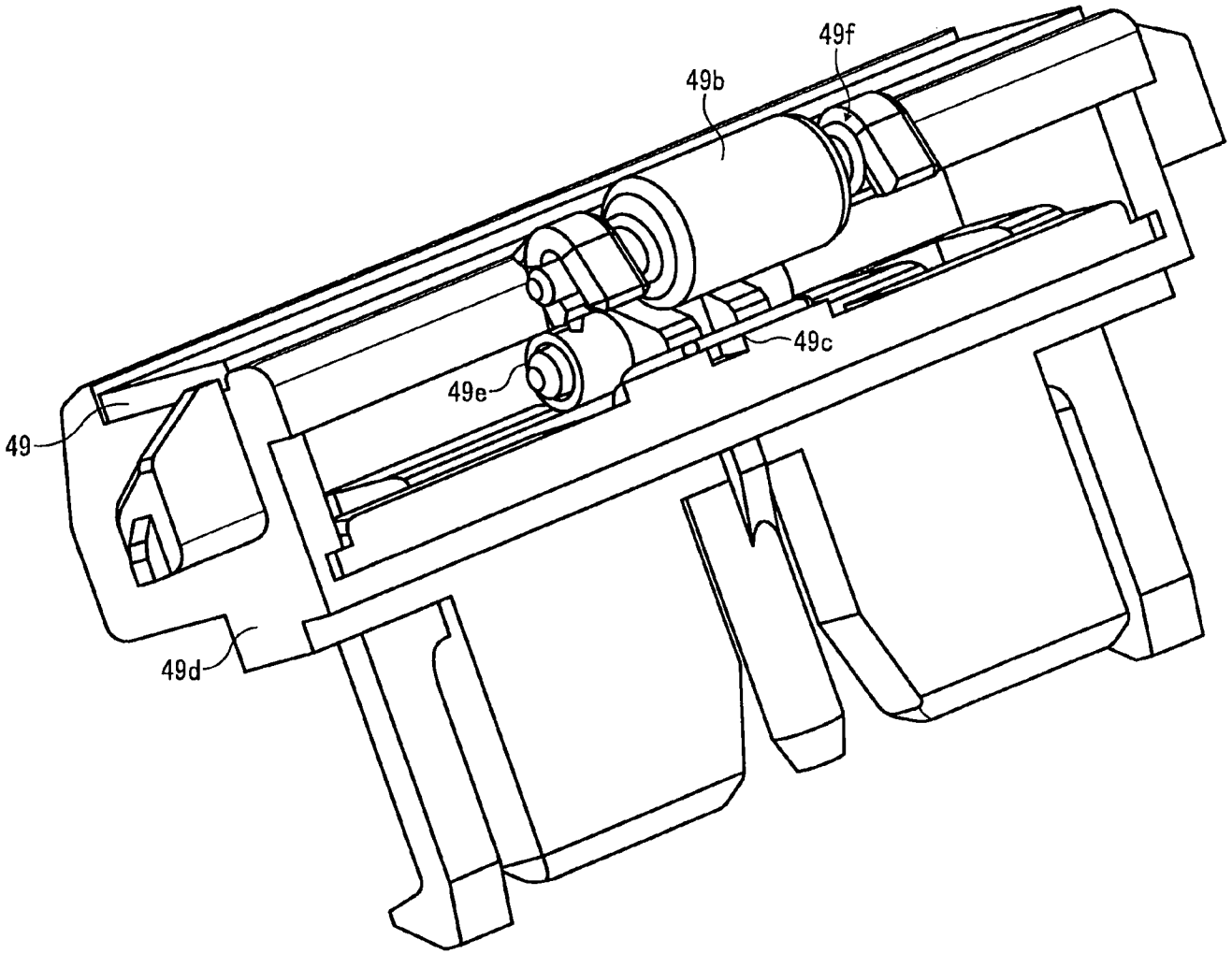
FIG. 3 is a perspective view of the feeding roller arranging portion shown in FIG. 2.

FIG. 2 is a schematic diagram of a feeding roller arranging portion of a sheet feeding device according to the first embodiment, and FIG. 3 is a perspective view thereof. The feed roller 48 is arranged above the most downstream end of the stacking tray 41 in the sheet conveying direction to touch the topmost recording sheet P of the sheets stacked on a bottom plate 43. A feed-roller driving mechanism (not shown) driven by a driving source (not shown) drives the feed roller 48 to rotate in the direction indicated by an arrow B shown in FIG. 2. The friction pad 49 is supported by a pad support 49*d*, as is the case in the conventional structure, and is arranged in contact with the surface of the feed roller 48 at a first area R1 located close to the feed roller 48 in a sheet drawing direction. The term "close to" used here refers to a position that is within 45° (that is, angle $\theta \leqq 45°$) from a sheet drawing position C in a rotation direction of the feed roller 48. As in the conventional structure, the pad support 49*d* is elastically biased towards a rotation center of the feed roller 48 by an elastic force by a spring 49*a* due to which the friction pad 49 is in contact with the feed roller 48 with a predetermined contact pressure.

In the present embodiment, a first contact-point member 49*b* is arranged in contact with the feed roller 48 at a location downstream of the friction pad 49 in the sheet conveying direction, and nips the recording sheet P with the feed roller 48. The first contact-point member 49*b* is rotatably supported at a second area R2 close to the friction pad 49 by a holding member 49*f* and is driven to rotate by the rotation of the feed roller 48. Furthermore, the first contact-point member 49*b* is swingably supported by a swinging shaft 49*e* in a state of being elastically biased towards the feed roller 48 by a torsion spring 49*c*. The torsion spring 49*c* is arranged between the swinging shaft 49*e* and the holding member 49*f*, and applies a nip pressure to the first contact-point member 49*b* to nip the recording sheet P between the first contact-point member 49*b* and the feed roller 48

Thus, with this structure, the recording sheet P drawn by the feed roller 48 from the stacking tray 41 is nipped at the first area R1 by the feed roller 48 and the friction pad 49 and conveyed along the rotation direction of the feed roller 48. On the downstream side of the feed roller 48 in the rotation direction, the recording sheet P is nipped by the feed roller 48 and the first contact-point member 49*b* at the second area R2 located on the downstream of the first area R1 and conveyed along the sheet conveying path 42. At this time, the recording sheet P is conveyed while being held at two points of the first area R1 and the second area R2 downstream of the first area R1. Consequently, stick-slip vibrations resulting from the friction between the friction pad 49 and the recording sheet P are suppressed, so that conveying behavior and conveying accuracy of the recording sheet P become stable, enabling to suppress occurrence of the abnormal sound due to the vibrations.

A material that has a high elastic coefficient such as rubber or silicon is preferably used for the surface of the first contact-point member 49*b* that is arranged in contact with the feed roller 48. Moreover, the surface of the first contact-point member 49*b* that is arranged in contact with the feed roller 48 can be made of fluororesin or coated with fluorine, that is, a material having a lower frictional coefficient than that of the feed roller 48 can be used for the surface of the first contact-point member 49*b*. The pad support 49*d* that supports the friction pad 49 is supported to be movable linearly in a direction normal to the surface of the feed roller 48 and is elastically biased in the direction.

Only one first contact-point member 49*b* shown in FIG. 2 is provided in the sheet conveying direction and a sub-scanning direction.

According to the first embodiment, the following effects are realized.

1) A nip is formed between the feed roller 48 and the friction pad 49 and also between the feed roller 48 and the first contact-point members 49*b*, 49*g*, 49*ha*, 49*hb*, 49*hc*, 49*k*, and 49*s*. Because two nips are formed, the friction between the friction pad 49 and the recording sheet P can be suppressed, so that conveying behavior and conveying accuracy of the recording sheet P become stable, enabling to suppress occurrence of the abnormal sound.

2) Because the pad support 49*d* is elastically biased towards the rotation center of the feed roller 48 by the elastic force by the spring 49*a*, both the nip between the feed roller 48 and the friction pad 49 and the nip on the circumference of the feed roller 48 function effectively. In addition, the recording sheet P is held with increased holding force, so that conveying behavior and conveying accuracy of the recording sheet P become stable, enabling to suppress occurrence of the abnormal sound.

3) The torsion springs 49*c*, 49*ia*, 49*ib*, 49*ic*, and 49*m* are used for applying a predetermined nip pressure to the first contact-point members 49*b*, 49*g*, 49*ha*, 49*hb*, 49*hc*, 49*k*, and 49*s*. Consequently, variations in the elastic biasing force due to variations in the component dimensions are reduced, and a stabilized biasing force can be achieved. Consequently, conveying behavior and conveying accuracy of the recording sheet P become stable, enabling to suppress occurrence of the abnormal sound.

4) Because the first contact-point members 49*b*, 49*g*, 49*ha*, 49*hb*, 49*hc*, 49*k*, and 49*s* are provided on the pad support 49*d*, variations in the relative positional relationship between the friction pad 49 and the first contact-point members 49*b*, 49*g*, 49*ha*, 49*hb*, 49*hc*, 49*k*, and 49*s* can be reduced, so that variations in the component dimensions are reduced. Consequently, conveying behavior and conveying accuracy of the recording sheet P become stable, enabling to suppress occurrence of the abnormal sound.

5) Because the swinging shafts 49*e*, 49*ja*, 49*jb*, 49*jc*, and 49*o* of the torsion springs 49*c*, 49*ia*, 49*ib*, 49*ic*, and 49*m* are provided on the pad support 49*d*, variations in the elastic biasing force due to variations in the component dimensions are reduced, so that a stabilized biasing force can be achieved. Consequently, conveying behavior and conveying accuracy of the recording sheet P become stable, enabling to suppress occurrence of the abnormal sound.

6) Because the first contact-point members 49*b*, 49*g*, 49*ha*, 49*hb*, 49*hc*, 49*k*, and 49*s* are provided such that they are driven by the rotation of the feed roller 48, it is possible to reduce a load on the first contact-point members 49*b*, 49*g*, 49*ha*, 49*hb*, 49*hc*, 49*k*, and 49*s* when the recording sheet P enters and wear of the first contact-point members due to the friction between the first contact-point members 49*b*, 49*g*, 49*ha*, 49*hb*, 49*hc*, 49*k*, and 49*s* and the recording sheet P. Thus, a stabilized biasing force can be achieved. Consequently, conveying behavior and conveying accuracy of the recording sheet P become stable, enabling to suppress occurrence of the abnormal sound.

7) Because the surface of the first contact-point members 49*b*, 49*g*, 49*ha*, 49*hb*, 49*hc*, 49*k*, and 49*s* is made of an elastic material, the stick-slip vibrations resulting from the friction between the friction pad 49 and the recording sheet P can be absorbed or dampened. Consequently, conveying behavior and conveying accuracy of the recording sheet P become stable, enabling to suppress occurrence of the abnormal sound.

8) Because the frictional coefficient of the surface of the first contact-point members 49*b*, 49*g*, 49*ha*, 49*hb*, 49*hc*, 49*k*, and 49*s* is configured to be less than that of the feed roller 48, a conveying force can be applied to the recording sheet P even at the nip between the feed roller 48 and the first contact-point members 49*b*, 49*g*, 49*ha*, 49*hb*, 49*hc*, 49*k*, and 49*s*. Consequently, failure of conveyance of the recording sheet P can be suppressed.

9) Because the friction pad 49 is elastically biased linearly towards the rotation center of the feed roller 48, a stabilized elastic biasing force can be achieved.

Figure 4:
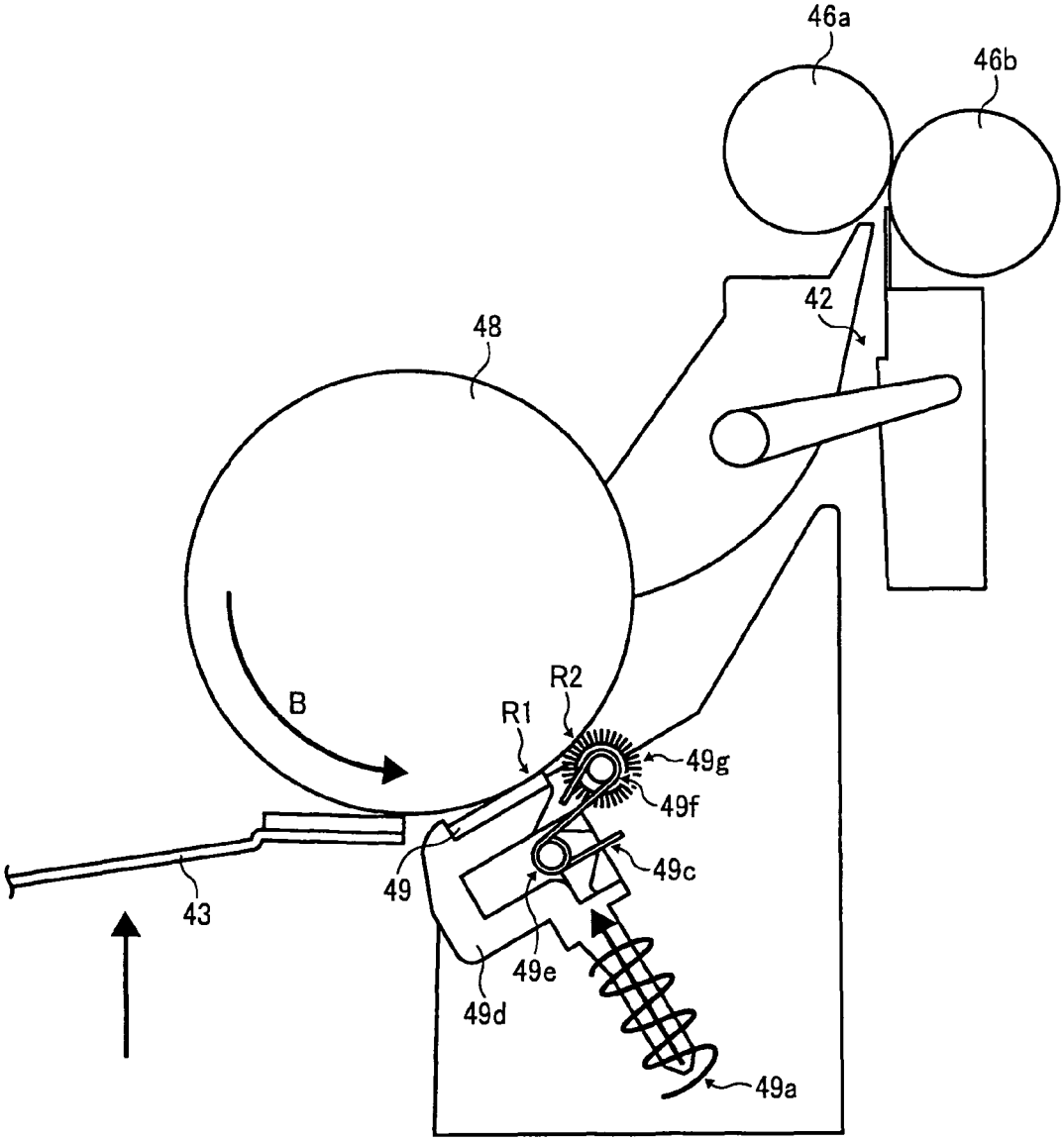
FIG. 4 is a schematic diagram of a feeding roller arranging portion of a sheet feeding device according to a second embodiment of the present invention.

FIG. 4 is a schematic diagram of a feeding roller arranging portion of a sheet feeding device according to a second embodiment of the present invention.

The sheet feeding device according to the second embodiment includes the first contact-point member 49*g* instead of the first contact-point member 49*b* according to the first embodiment of which surface is made of a material having high elastic coefficient or low frictional coefficient. The first contact-point member 49*g* includes a brush roller with the surface of the roller made of a brush material. The brush roller can rotate along with the conveyance of the recording sheet P thereby removing paper dust or other foreign matter adhering to the surface of the recording sheet P. Furthermore, in the case of successively conveying sheets, the first contact-point member (brush roller) 49*g* can come into contact with the feed roller 48 between two successive sheets, thereby removing paper dust or other foreign matter adhering to the surface of the feed roller 48. Moreover, when the stacking tray 41 is out of paper, the feed roller 48 can be forcibly rotated to clean the surface thereof, enabling to improve cleaning performance for the feed roller 48. Only one first contact-point member (brush roller) 49*g* shown in FIG. 4 is provided in the sheet conveying direction and the sub-scanning direction.

The other parts of the sheet feeding device according to the second embodiment are both structurally and functionally identical to those according to the first embodiment.

According to the second embodiment, the following effect is realized in addition to those in the first embodiment.

Because the surface of the first contact-point member 49*g* is made of a brush material, paper dust or other foreign matter adhering to the surface of the feed roller 48 can be cleaned, thus enhancing the durability of the feed roller 48. In addition, conveying behavior and conveying accuracy of the recording sheet P become stable, enabling to suppress occurrence of the abnormal sound.

Figure 5A:
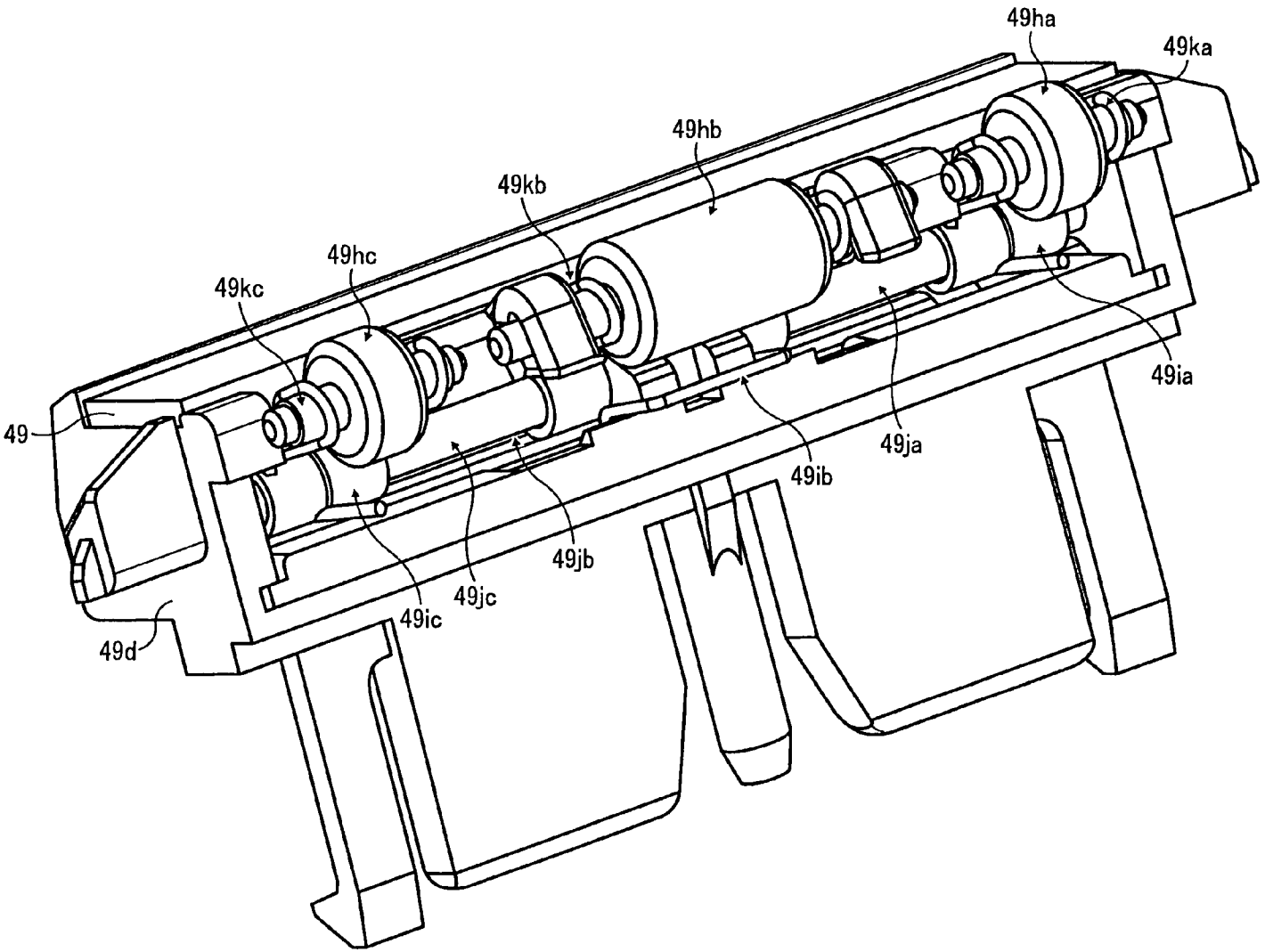
FIGS. 5A and 5B are perspective views of a feed roller arranging portion of a sheet feeding device according to a third embodiment of the present invention.
Figure 5B:
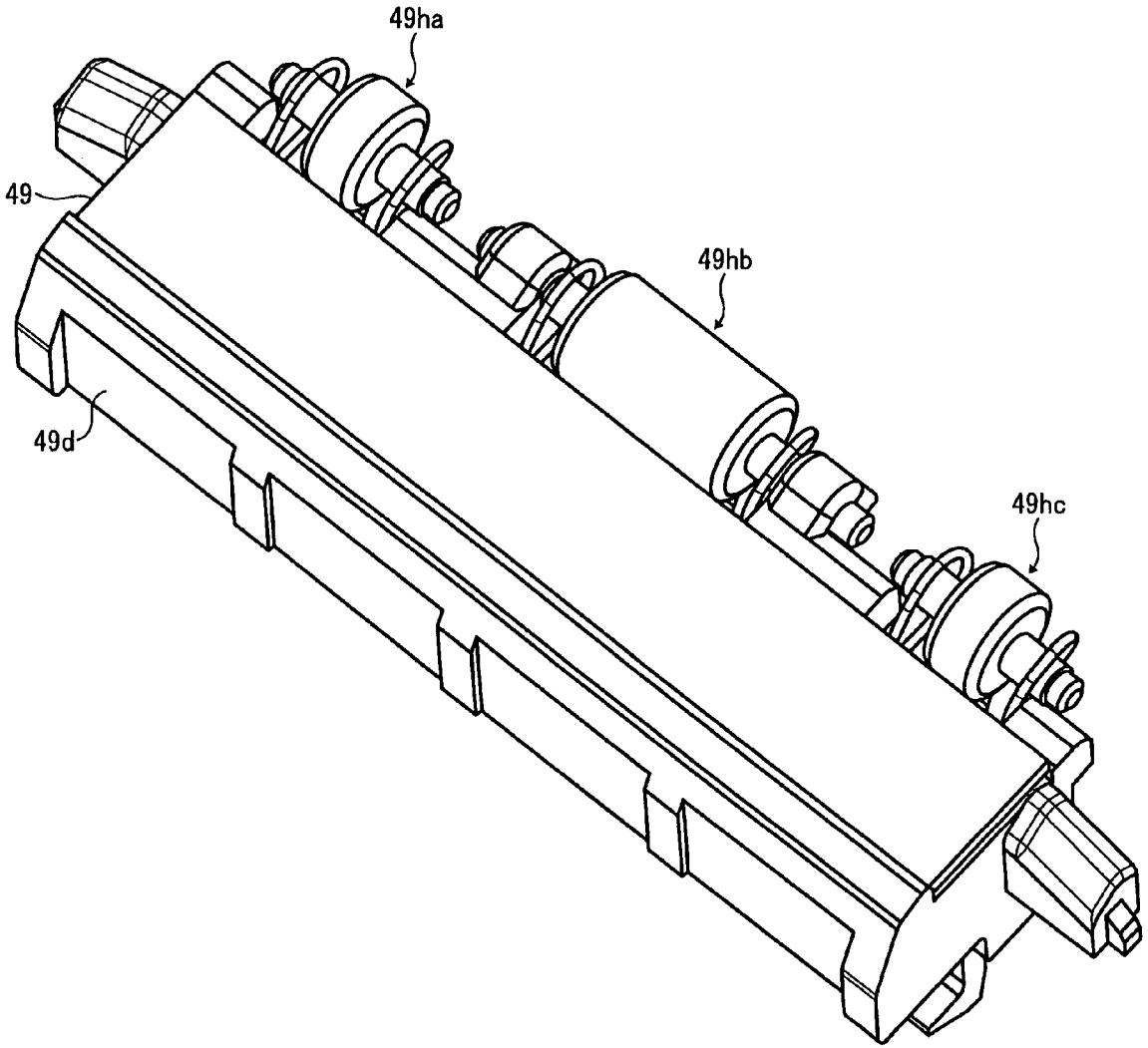

FIGS. 5A and 5B are perspective views of a feed roller arranging portion of a sheet feeding device according to a third embodiment of the present invention, in which FIG. 5A is a view from a side from which the sheet conveying path can be seen and FIG. 5B is a rear view.

In the third embodiment, which is a modification of the second embodiment, a first contact-point member 49*h* is provided at three places in the sub-scanning direction, that is, first contact-point members 49*ha*, 49*hb*, and 4*hhc* are provided in this order from a far side as shown in FIGS. 5A and 5B. The first contact-point members 49*ha*, 49*hb*, and 49*hc* are elastically biased by torsion springs 49*ia*, 49*ib*, and 49*ic*, respectively, and are swingably supported by swinging shafts 49*ja*, 49*jb*, and 49*jc* of the torsions springs 49*ia*, 49*ib*, and 49*ic*, respectively. When driven to rotate by the rotation of the feed roller 48, the first contact-point members 49*ha*, 49*hb*, and 49*hc* rotate about holding members 49*ka*, 49*kb*, and 49*kc* of the torsion springs 49*ia*, 49*ib*, and 49*ic*, respectively.

An elastic biasing force is set larger for the middle torsion spring 49*ib* that biases the first contact-point member 49*hb* than for the torsion springs 49*ia* and 49*ic* that bias the first contact-point members 49*ha* and 49*hc*, respectively. Furthermore, the middle first contact-point member 49*hb* is larger in a width direction than the first contact-point members 49*ha* and 49*hc*. With this structure, sheet conveyance velocities at the center and on either side of the feed roller 48 are made to vary, so that the recording sheet P can be stretched outward with the mid portion of the recording sheet P as a center.

The recording sheet P is nipped at the second area R2 at three places, that is, between the feed roller 48 and each of the first contact-point members 49*ha*, 49*hb*, and 49*hc*. Including the first area R1 where the recording sheet P is held between the friction pad 49 and the feed roller 48, the recording sheet P is held at four places. Consequently, the stick-slip vibrations resulting from the friction between the friction pad 49 and the recording sheet P can be further suppressed.

The other parts of the sheet feeding device according to the third embodiment are both structurally and functionally identical to those according to the first embodiment.

According to the third embodiment, the following effects are realized in addition to those in the first embodiment.

1) Because a plurality of the first contact-point members 49*ha*, 49*hb*, and 49*hc* is provided orthogonal to the sheet conveying direction, the recording sheet P is held with increased holding force. Consequently, conveying behavior and conveying accuracy of the recording sheet P become stable, enabling to suppress occurrence of the abnormal sound.

2) The elastic biasing forces of the first contact-point members 49*ha*, 49*hb*, and 49*hc* towards the feed roller 48 are made to vary according to the position, so that it is possible to produce the force to stretch the recording sheet P outward with the mid portion of the recording sheet P as a center. Consequently, warping of the recording sheet P, which may occur in conveying the recording sheet P, can be suppressed.

Figure 6:
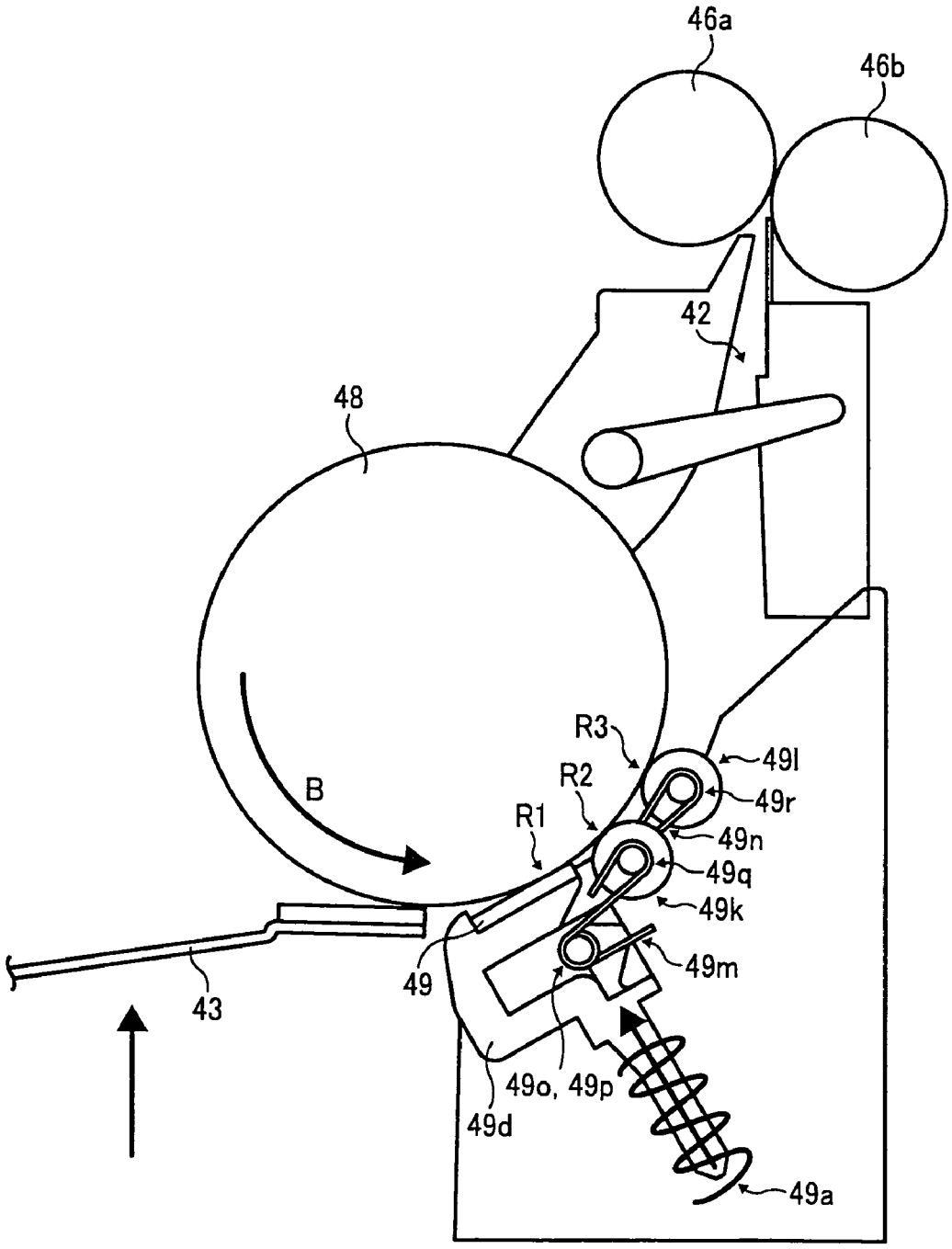
FIG. 6 is a schematic diagram of a feeding roller arranging portion of a sheet feeding device according to a fourth embodiment of the present invention.

FIG. 6 is a schematic diagram of a feeding roller arranging portion of a sheet feeding device according to a fourth embodiment of the present invention. In the fourth embodiment, a second contact-point member 491 is provided downstream of the first contact-point member 49*b* of the first embodiment shown in FIGS. 2 and 3 in the sheet conveying direction.

Specifically, as shown in FIG. 6, torsion springs 49*m* and 49*n* are arranged between swinging shafts 49*o* and 49*p*, which are aligned in a shaft direction in FIG. 6 and are provided on the pad support 49*d*, and holding members 49*q* and 49*r* of a first contact-point member 49*k* and the second contact-point member 49*l*, respectively, and the first contact-point member 49*k* and the second contact-point member 49*l* are elastically biased towards the feed roller 48 to be swingable with respect to the swinging shafts 49*o* and 49*p* by the torsion springs 49*m* and 49*n*, respectively. Thus, the friction pad 49 is in contact with the feed roller 48 at the first area R1, the first contact-point member 49*k* is in contact with the feed roller 48 at the second area R2, and the second contact-point member 49*l* is in contact with the feed roller at a third area R3.

According to the fourth embodiment, the recording sheet P is nipped at the first area R1 by the feed roller 48 and the friction pad 49 and conveyed in the rotation direction of the feed roller 48. Furthermore, the recording sheet P is nipped by the feed roller 48 and the first contact-point member 49*k* at the second area R2 downstream of the first area R1 in the rotation direction of the feed roller 48 and further nipped by the feed roller 48 and the second contact-point member 49*l* at the third area R3 downstream of the second area R2, and is conveyed in this state. Thus, because the recording sheet P is held at three places along the sheet conveying direction, the stick-slip vibrations resulting from the friction between the friction pad 49 and the recording sheet P can further be suppressed. Consequently, conveying behavior and conveying accuracy of the recording sheet P become stable, enabling to suppress occurrence of the abnormal sound. Moreover, the first contact-point member 49*k* and the second contact-point member 49*l* are arranged along the circumference of the feed roller 48 in the sheet conveying path to nip the recording sheet P with the feed roller 48. Consequently, a sheet discharge path can be bent sharply tracing the curvature of the feed roller 48. As a result, layout constraint is eased and space saving is realized.

The other parts of the sheet feeding device according to the fourth embodiment are both structurally and functionally identical to those according to the first embodiment.

According to the fourth embodiment, the following effects are realized in addition to those in the first embodiment.

1) Because the recording sheet P is held at a plurality of places along the sheet conveying direction by the first contact-point member 49*k* and the second contact-point member 49*l*, the recording sheet P is held with increased holding force. Consequently, conveying behavior and conveying accuracy of the recording sheet P become stable, enabling to suppress occurrence of the abnormal sound.

2) Because the recording sheet P is held at a plurality of places along the sheet conveying direction, the recording sheet P follows the sheet discharge path even if it is bent sharply. Consequently, there is little layout constraint and space saving is achieved.

Figure 7:
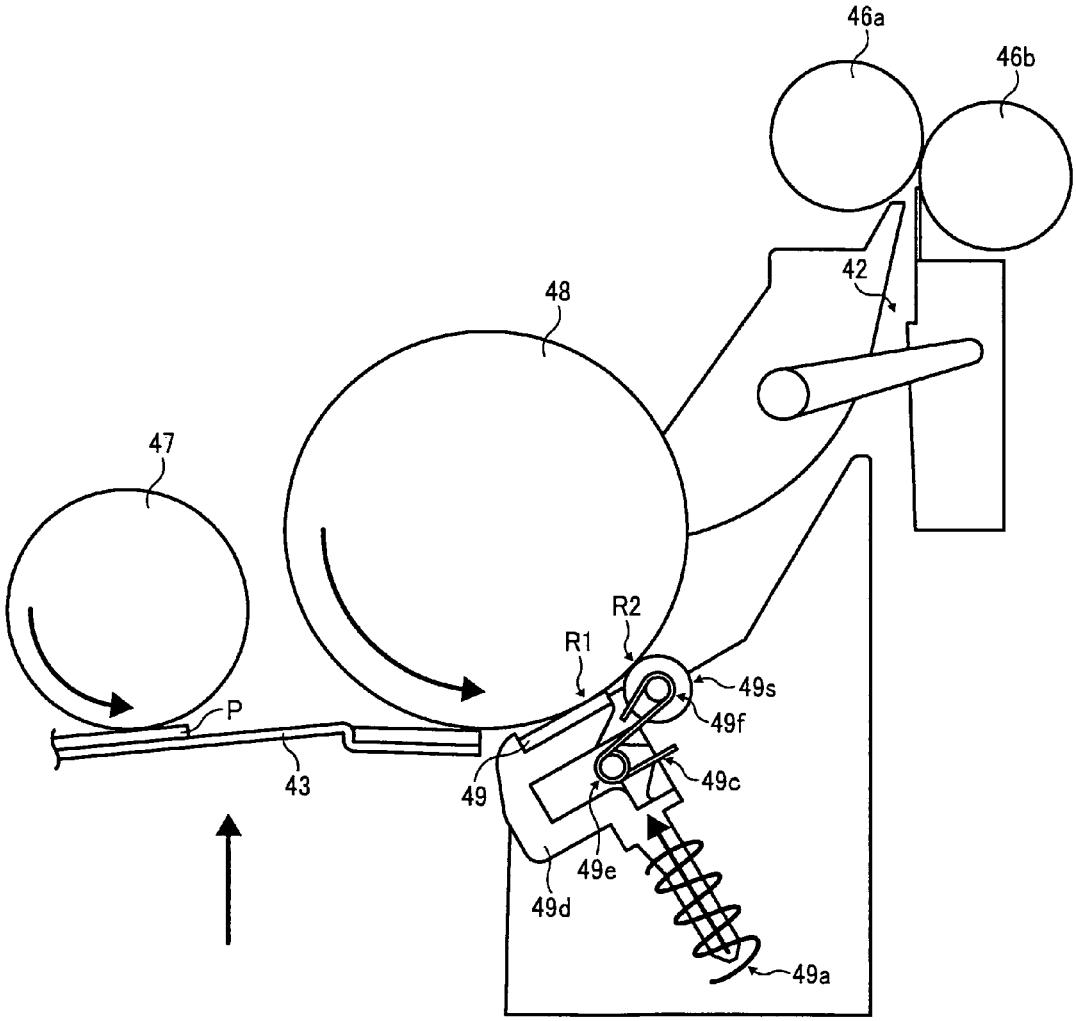
FIG. 7 is a schematic diagram of a feeding roller arranging portion of a sheet feeding device according to a fifth embodiment of the present invention.
Figure 8:
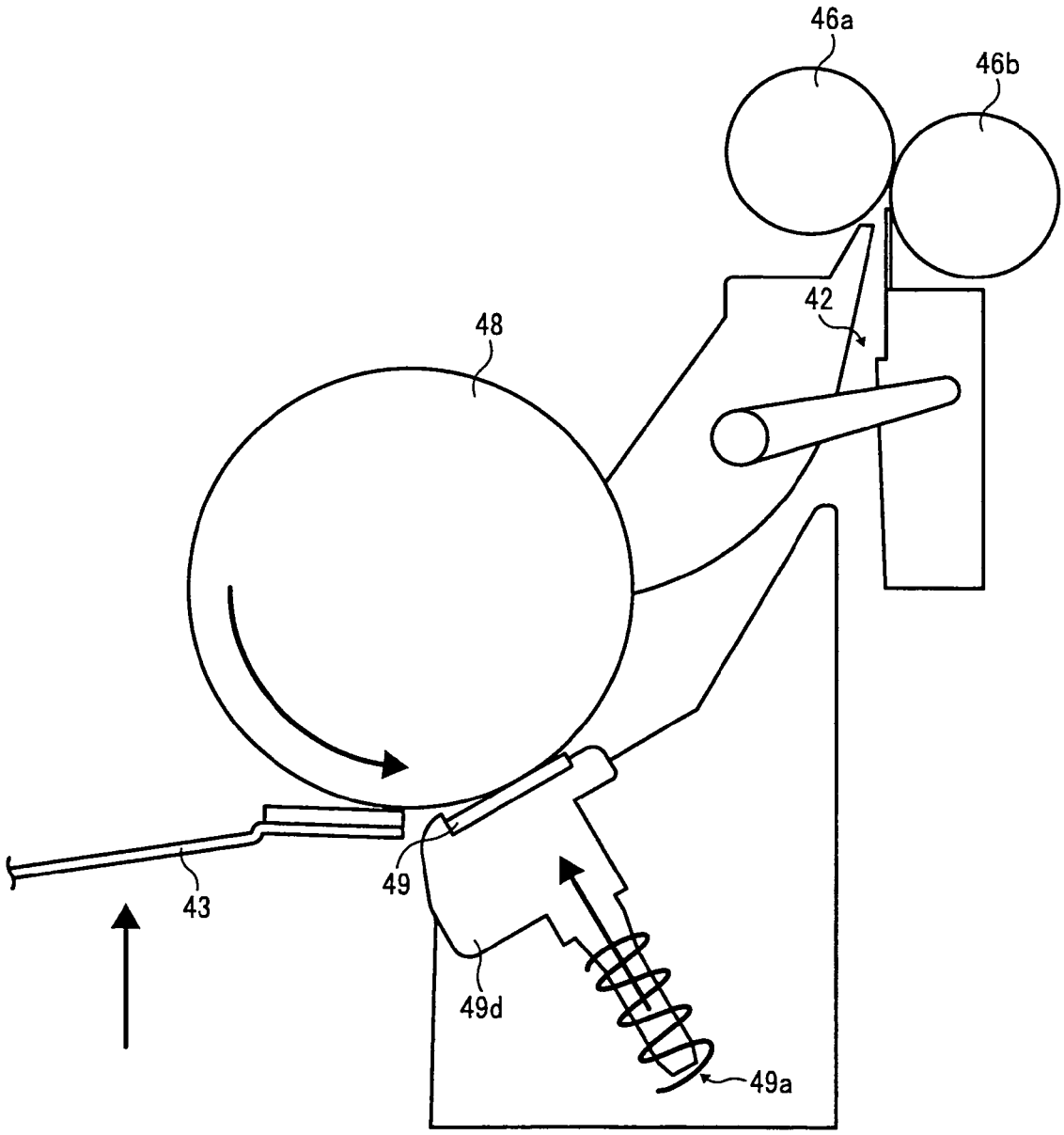
FIG. 8 is a schematic diagram of a feed roller arranging portion of a conventional sheet feeding device.

FIG. 7 is a schematic diagram of a feeding roller arranging portion of a sheet feeding device according to a fifth embodiment of the present invention. In the fifth embodiment, a pickup roller 47 is provided upstream of the feed roller 48 according to the first embodiment shown in FIGS. 2 and 3 in the sheet conveying direction.

The pickup roller 47 picks up the topmost recording sheet P from the stacking tray 41, after which the recording sheet P is guided to the nip formed between the feed roller 48 and the friction pad 49. If multi feed occurs at the pickup roller 47, the friction pad 49 separates the sheets at the first area R1 and the sheet is then conveyed to the second area R2 as in the first embodiment. As in the first embodiment, the stick-slip vibrations can be suppressed by the holding force of the recording sheet P between a first contact-point member 49*s* and the feed roller 48, enabling to suppress occurrence of the abnormal sound.

The other parts of the sheet feeding device according to the fifth embodiment are both structurally and functionally identical to those according to the first embodiment.

According to the fifth embodiment, the following effect is realized in addition to those in the first embodiment.

Because the recording sheet P is held at three places along the sheet conveying direction, namely, in the nips formed between the pickup roller 47 and the underlying recording sheet P, between the feed roller 48 and the friction pad 49, and between the feed roller 48 and the first contact-point member 49*s*, the recording sheet P is held with increased holding force, so that conveying behavior and conveying accuracy of the recording sheet P become stable, enabling to suppress occurrence of the abnormal sound.

The present invention is not limited to the embodiments, and all technical matters included in technical ideas described in claims are also included in the present invention.

In the embodiments explained above, the recording sheet P corresponds to a recording medium, the feed roller 48 corresponds to a first roller, the friction pad 49 corresponds to a friction pad, the first contact-point members 49*b*, 49*g*, 49*ha*, 49*hb*, 49*hc*, 49*k*, and 49*s* correspond to a second roller, the second contact-point member 49*l* corresponds to a third roller, the pickup roller 47 corresponds to a fourth roller, the torsion springs 49*c*, 49*ia*, 49*ib*, 49*ic*, 49*m*, and 49*n* correspond to an elastic biasing member, the swinging shafts 493, 49*ja*, 49*jb*, 49*jc*, 49*o*, and 49*p* correspond to a swinging shaft, the pad support 49*d* corresponds to a pad support, the sheet feeding device 4 corresponds to a sheet feeding device, the image forming apparatus corresponds to a printer PR, the first area R1 corresponds to a contact portion between the friction pad and the first roller, the second area R2 corresponds to a position close to and downstream of the contact portion between the friction pad and the first roller in a sheet conveying direction, and the third area R3 corresponds to a position close to and downstream of the second roller in the sheet conveying direction.

According to an aspect of the present invention, instable conveying behavior of a recording sheet can be solved and occurrence of the abnormal sound can be suppressed with a simple structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a first roller configured to draw a recording medium at a first position and feed the recording medium;

a friction pad configured to contact the first roller with a contact pressure at a second position that is close to and downstream of the first position in a conveying direction of the recording medium and nip the recording medium with the first roller to convey the recording medium in the conveying direction; and a second roller configured to contact the first roller at a third position that is close to and downstream of the second position in the conveying direction and nip the recording medium with the first roller, wherein a coefficient of friction of a surface of the second roller is smaller than a coefficient of friction of a surface of the first roller.

2. The sheet feeding device according to claim 1, further comprising:

an elastic biasing unit configured to elastically bias the second roller towards the first roller to apply a nip force to the second roller.

3. The sheet feeding device according to claim 2, wherein the elastic biasing unit includes a torsion spring supported by a swinging shaft, and the second roller is biased to be swingable about the swinging shaft.

4. The sheet feeding device according to claim 1, further comprising:

a pad support configured to hold the friction pad, wherein the second roller is supported by the pad support.

5. The sheet feeding device according to claim 1, wherein the second roller is configured to be driven to rotate by a rotation of the first roller.

6. The sheet feeding device according to claim 1, wherein a surface of the second roller is composed of an elastic member.

7. The sheet feeding device according to claim 1, wherein a surface of the second roller is composed of a brush member.

8. The sheet feeding device according to claim 1, wherein the second roller includes a plurality of second rollers provided in a direction orthogonal to the conveying direction.

9. The sheet feeding device according to claim 8, wherein, a second roller arranged on an inner side in the direction orthogonal to the conveying direction is configured to nip the recording medium with a nip force larger than that of a second roller arranged on an outer side among the second rollers.

10. The sheet feeding device according to claim 1, further comprising:

at least one third roller configured to contact the first roller at a position that is close to and downstream of the second roller in the conveying direction and nip the recording medium with a nip force.

11. The sheet feeding device according to claim 1, further comprising:

a fourth roller configured to pick up the recording medium and provided upstream of the first roller in the conveying direction.

12. An image forming apparatus comprising a sheet feeding device that includes a first roller configured to draw a recording medium at a first position and feed the recording medium;

a friction pad configured to come into contact with the first roller with a contact pressure at a second position that is close to and downstream of the first position in a conveying direction of the recording medium and nip the recording medium with the first roller to convey the recording medium in the conveying direction; and a second roller configured to come into contact with the first roller at a third position that is close to and downstream of the second position in the conveying direction and nip the recording medium with the first roller, wherein a coefficient of friction of a surface of the second roller is smaller than a coefficient of friction of a surface of the first roller.

13. A sheet feeding method that is implemented on a sheet feeding device that includes a first roller configured to draw a recording medium at a first position and feed the recording medium, a friction pad configured to come into contact with the first roller with a contact pressure at a second position that is close to and downstream of the first position in a conveying direction of the recording medium and nip the recording medium with the first roller to convey the recording medium in the conveying direction, and a second roller configured to contact the first roller at a third position that is close to and downstream of the second position in the conveying direction and nip the recording medium with the first roller, wherein a coefficient of friction of a surface of the second roller is smaller than a coefficient of friction of a surface of the first roller, the sheet feeding method comprising:

nipping the recording medium at the third position between the first roller and the second roller; and conveying the recording medium in a state of being nipped at the nipping.

14. The sheet feeding method according to claim 13, wherein the nipping further includes nipping the recording medium at a plurality of positions in a direction orthogonal to the conveying direction.

15. The sheet feeding method according to claim 13, wherein the nipping further includes nipping the recording medium at a plurality of positions along the conveying direction.

* * * * *